US005398353A

United States Patent [19]

Sachathamakul

[11] Patent Number: 5,398,353

[45] Date of Patent: Mar. 21, 1995

[54] MULTI-DIRECTIONAL ROCKING CRIB

[75] Inventor: Rakeshwar Sachathamakul, Bangkok, Thailand

[73] Assignee: Mother's Love PTE. Ltd., Singapore

[21] Appl. No.: 50,519

[22] Filed: Apr. 20, 1993

[51] Int. Cl.[6] ..... A47D 9/04

[52] U.S. Cl. ..... 5/109; 5/105

[58] Field of Search ..... 5/108, 109, 105, 106

[56] References Cited

U.S. PATENT DOCUMENTS

| | | | |
|---|---|---|---|
| 2,664,575 | 1/1954 | Lee | 5/109 |
| 2,668,302 | 2/1954 | Dengrove | 5/109 |
| 2,805,427 | 9/1957 | Edgmon | 5/109 |
| 2,916,745 | 12/1959 | Lesk et al. . | |
| 2,979,735 | 4/1961 | Helmer | 5/105 |
| 3,123,019 | 3/1964 | Blair | 5/109 |
| 4,084,273 | 4/1978 | Haynes | 5/105 |
| 4,620,334 | 11/1986 | Robinson | 5/109 |
| 4,856,130 | 8/1989 | Berkovich | 5/109 |

FOREIGN PATENT DOCUMENTS 1451981 6/1975 United Kingdom .

*Primary Examiner*—Michael J. Milano

*Attorney, Agent, or Firm*—McAulay Fisher Nissen Goldberg & Kiel

[57] ABSTRACT

A multi-directional rocking crib, having a base which pivots about a pivot member, a first member operatively associated with the pivot and a second member having at least one arm with a weight at the end thereof extending transversely to and connected with the first member, a motor to rotate the arm with the weight at the end thereof for tilting of the base or movement of the base as the first member rotates relative to the pivot to provide an undulating movement of the edge of each side of the base as the pivot rotates to move the base into and out of the different planes.

21 Claims, 5 Drawing Sheets

MULTI-DIRECTIONAL ROCKING CRIB

BACKGROUND OF THE INVENTION

This invention relates to a rocking crib and, more particularly, the invention is concerned with a multi-directional rocking crib which can have its sides moved in an undulating motion.

There have been many external source stimulants used to induce sleep to a newborn infant. Heretofore, a rocking action has been imparted to a crib or bed so that usually one side is uniformly raised and the other side is uniformly lowered and, in effect, one long side is raised or lowered about a center pivot or about a long axis through the longitudinal center of the crib. Specifically, taking a rectangular crib, for example, with two length or long sides and two width or short sides orthogonally connected to the long sides, when a rocking action is imparted to the crib, one of the length or long sides is raised and the other substantially parallel length side is lowered, while the width sides form an inclination between the length sides with one end of each width side being raised and the other end lowered, and the intermediate portions of the width or short sides being moved to a lower position in a uniformly decreasing position.

While the conventional crib could be rocked to see-saw about a central transverse axis perpendicular to the two long sides, such rocking is usually not done.

An object of the present invention is to achieve a multi-directional rocking of a crib so that rocking does not take place solely about a long axis or, for that matter, solely along a short axis orthogonal to the long axis or any diagonal axis, and to simulate a rocking action which takes place in the mother's womb, particularly because the unborn infant or foetus is, in effect, tethered to the mother by the mother's umbilical cord and, more specifically, the foetus should be considered to be suspended in an amniotic sac and susceptible to motion due to movement of the mother and external forces.

With the present invention, it is proposed to impart an external stimulant or environment to a newborn infant which simulates the last three months of its gestation. The external source stimulant induces the baby to go to sleep. The stimulant consists of the environment that replicates the mother's womb environment. The environment consists of the external stimulus a baby can feel or be subjected to while it is in the mother's womb. It is basically proven that, by the sixth month of gestation, a baby has developed most of its senses. While the baby is sleeping in the mother's womb, and moves from a wake state cycle to the period in which the baby enters into a deep sleep and the REM state, the baby thus forms a sleep cycle habit with the external environmental stimulant. This habit forming pattern while the baby is in the period of gestation is etched into the baby's pattern or habit before passing from the wake cycle state to the deep sleep state. Because the baby's senses are developed during gestation, the baby can thus sense these stimulants.

The stimulants consist of:

A) Sense of Hearing—The mother's womb sound:

The mother's womb sounds consist of a baby's heartbeat sound mixed with the amniotic fluid in the mother's womb. Such a regular rhythmetic sound provides the baby one of the external stimulants that is etched into the baby's habitual pattern. Now, it has been scientifically proven that the sound of the mother's womb can be eighty-six percent (86%) effective in pacifying a baby, and thirty-five percent (35%) effective in inducing a baby to sleep.

B) Sense of Sight—Colors with no distinguished patterns:

As the body is a permeable substance, it is assumed that, in daylight, some of this light passes into the womb. The amniotic fluid according to the baby can consist of many colors, as the light that is passing through the body may consist of many different colors, depending on the source of the light. Since a baby's eyes are not focused, it is expected that a baby may see shapes of colors while in the mother's womb.

C) Sense of Touch—Underwater sensations:

As the baby is underwater, it can be assumed that such sensation will feel as if we are underwater. This consists of a slight vibrational stimulant that is constantly working on all parts of the body.

D) Sense of Smell—The smell of the amniotic fluid:

As it can definitely be understood, as the baby is enclosed in a sac of amniotic fluid, the only smell it can smell is the amniotic fluid. This is a very restricted sense.

E) Sense of Balance—Multi-directional rocking movement:

Because the baby is suspended within the mother's womb, and it is constantly rocking slowly in the mother's womb in all directions in response to external movements. Further, as the mother moves, the baby also rocks in a certain direction responsive to the mother's movement. A rocking movement has been used for centuries now in inducing a baby to sleep.

By replicating the womb's environment, a baby's sleep disorder problems may be reduced. It is believed that babies can be induced to sleep faster by a rocking action simulating the rocking action to which the foetus was subjected during the last three months of gestation.

It is therefore another object of the invention to create or replicate the mother's womb environment for sleeping purposes effectively by providing a crib which not only rocks, also tilts to lower and raise adjacent sides while lowering adjacent sides having one of the adjacent sides in common which will provide stimulants as close as possible to the mother's womb environment.

The rocking or undulating crib which the present invention proposes to provide is not of the conventional type in which one side of the crib, possibly the long side, is moved so that the crib length is rocked about a center pivotal axis, much in the form of a see-saw, wherein one long side is raised to a point higher than the other and then lowered to a point lower than the other. For this purpose, some cribs have the four base legs provided with springs to assist in such rocking. Other forms of rocking are also imparted to a crib when the springs are not used with the legs.

It is believed that, during a child's first few weeks after delivery, the child is passing through a constant wake-sleep cycle throughout the day without passing through a state of drowsiness and light sleep. As the child grows until the sixth month, it is beginning to develop a wake-sleep cycle that may pass the child through a few states of drowsiness before entering deep sleep and REM.

The following is a chart to explain these states and the cycles throughout the day through which the child passes:

The first few weeks of an infant's life tends to follow the following pattern:

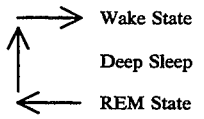

This cycle of wake-sleep cycle during the first few weeks may happen between seven to ten times during each twenty-four hour period, thus making the baby sleep approximately one to two hours before it enters into a wake state. However, as best understood after the first few months, the pattern or cycle changes to the following:

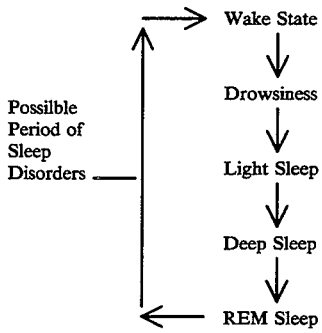

This cycle may occur from four to five times daily, so that the baby will sleep longer hours of time deviations of approximately three to four hours, thereby increasing the time or hours of deep sleep as well as the other states forming the cycle. During the stage of transitions, certain sleep disorders may exist. The pattern stated will persist throughout the child's life. Eventually, the child will develop a particularly unique sleep pattern which is specifically unique to that child, such as a one or two times per day sleep pattern, sleeping almost a total of ten hours. This stage usually occurs after six months from birth. In such a ten-hour period, the child may pass through the sleep cycle—perhaps four or five times per night.

Sleep disorder problems may occur between each sleep and wake cycle. It is also believed that the rocking crib produces stimulants or a stimulation or a soothing of the infant to reduce sleep disorders, by using the stimulants that the child has formed into a habit during the time of seven to nine months of gestation. The non-directional rocking crib is intended to perform two functions:

1) To provide a stimulus that is already a habit formed into the child for it to move smoothly onto a deep sleep state or to an REM state.
2) To provide a stimulus during the stage that the infant moves from REM sleep to light sleep, in order to render the transition smooth.

The main cause of a child's waking up or crying at night is caused by a lack of the habit formed stimulus which is created due to a change in the environment during the last trimester and the environmental change after birth. For example, the mother may rock the child to sleep but, when the child wakes up between the states, it is unable to go to sleep because nobody is rocking it. In other words, the stimuli are not there.

The following is a chart of how the product works:

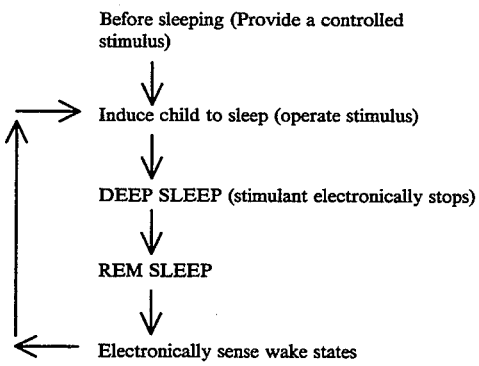

The invention can automatically provide an effective stimulus during the first initial period of falling asleep, and each period of sleep periods and wake periods, and by doing so will reduce effective problems of sleep disorders among children.

To these ends, the invention consists in the provision of a multi-directional rocking crib, having a base portion provided with a pivot about which the base portion pivots, a member such as an L-shaped member, having at least one arm with a weight at the end of the arm operatively associated with the pivot member and said at least one arm extending substantially parallel to the base of the base portion, and a motor or other means associated with the member having at least one arm for rotation thereof, and a weight at the end of the at least one arm to effect a tilting of the base portion or a movement of said base portion into different planes as the L-shaped member rotates relative to the pivot member to provide an undulating movement of the edge of each side of the base portion.

In a preferred embodiment of the invention, the member which is operatively associated with the pivot is a T-shaped member which includes a center member rotatably coupled with the pivot and a pair of arms forming the cross-bar of the T-shaped member, and a weight at the free end of each of the pair of arms so that each arm together with its associated weight forms a torque action on the center member, and the torque action produced by the combination of the end weight and length of the arm produces are different from each other to effect the tilting of the base portion or a movement of said base portion into different planes.

In one embodiment, the pivot member is a center pivot. In another embodiment, the pivot member is an offset pivot offset from a geometric center of the base portion; the base portion is substantially rectangularly-shaped and has two length sides and two width sides, the length sides being of greater extent than the two width sides, and the pivot member is disposed closer to at least one of the width sides.

While a preferred form of the invention includes two sides which are of a different size from the other two sides, a base portion, which is square instead of rectangularly-shaped will also be suitable. Also, it is possible for the base to have an outer perimeter which is circular or oval in shape.

To control the extent of vertical movement of at least one side, a projection is provided proximate to the side to have a different vertical movement from the other of the sides. The projection may also be used to maintain the base portion in a stable rest position with one of the width sides lower than the other of the sides.

A motor is coupled with the pivot member and the T-shaped member is coupled with the output shaft of the motor for rotation coaxially with the center of the pivot. The motor is coupled with the pivot member and the T-shaped member is coupled with the output shaft of the motor for rotation coaxially with a central axis of the pivot. Controls are also provided for controlling rotation of the T-shaped member, by regulating the speed of the motor.

The T-shaped member can also be provided with a non-directly connected motor and a belt coupling the motor and T-shaped member for rotation thereof, together with controls for regulating the speed of the motor.

It should also be noted that, in the embodiment in which an L-shaped member is used, the L-shaped member can also be provided with a non-directly connected motor and a belt coupling the motor and the L-shaped member.

For purposes of explanation and in a preferred embodiment, the multi-directional rocking crib includes a substantially rectangularly-shaped member for supporting an infant, and means are provided for raising one corner of the first set of two corners in a substantially vertical direction while lowering the other corner of the first set of two corners and lowering the one corner of the first set of two corners while commencing the raising of one corner of the other set of two corners and lowering the other corner of the other set of two corners and the one corner of the first set of two corners to impart an undulating movement to the rectangularly-shaped member, and at the head portion an elevation member is provided for controlling the extent to which the head portion is lowered when the feet portion is raised. To effect a raising of the different sides of the crib, a pair of arms are provided to rotate a weight on each arm about a pivot for lowering and raising the sides and corners of the crib.

If a single arm is used with a weight on the end of the arm, different sides of the crib base are lowered in response to the tilting of the crib about the pivot.

If a circular base is used, as an example, one portion is raised and a diagonally opposite portion is lowered, and the portion changes as the weighted member rotates. In a similar manner, an oval-shaped base operates to raise and lower substantially opposite portions.

The pivot member is at the bottom of the rectangularly-shaped member at an outside face portion thereof for contact with a flat surface and a T-shaped member or an L-shaped member is received in a rotatable joint coupled with the pivot for raising and lowering the base as the T-shaped member or the L-shaped member rotates relative to the pivot to cause the base to move in response to a rotatable see-saw action imparted to the base by the T-shaped member.

A weighted member is also provided so that the crib is balanced and does not result in a "hunting" condition to balance or maintain the crib in a non-undulating condition.

The T-shaped member and the L-shaped member can also be provided with suitable connectors so that the crib can be easily transportable.

DETAILED DESCRIPTION OF THE PREFERRED EMBODIMENT

Figure 1:
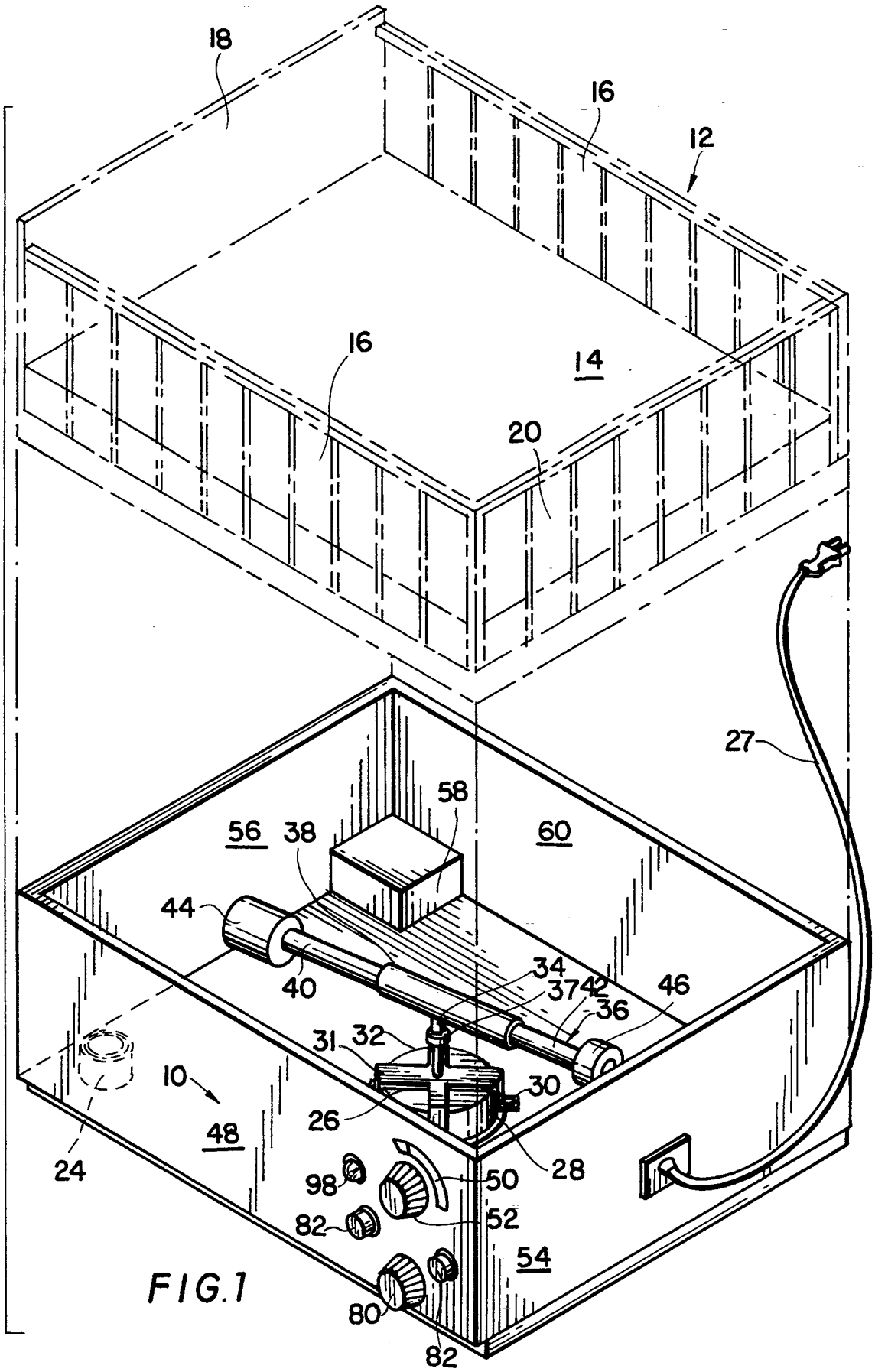
FIG. 1 is a perspective view of a multi-directional rocking crib showing one embodiment according to the invention, illustrating a base portion and a top portion opened and raised from the base portion.

Referring now to FIGS. 1 to 4 of the drawings and, more particularly, to FIG. 1 which shows the presently preferred mode for carrying out the invention, a multi-directional rocking crib according to one embodiment of the invention includes multi-directional rocking base 10 and crib or baby holding portion 12 acting as a closure or a surround for an infant, but removed for purposes of explanation, is shown.

Crib 14 is intended to rest on top of rocking base 10 and, while both are illustrated with substantially the same outer dimensions, the crib portion 14 can be much larger and even a portable folding type. Positioned within baby holding portion 12 is a conventional mattress 14, and the baby holding portion 12 is provided with the usual guard rails 16, headboard 18 and foot board 20.

While crib 12 is shown as the same size as base 10, it should be understood also that the base 10 can be much smaller and more compact than crib 12. While both base 10 and crib 12 are shown as rectangularly-shaped, they can have any suitable outer peripheral configuration.

Figure 3:
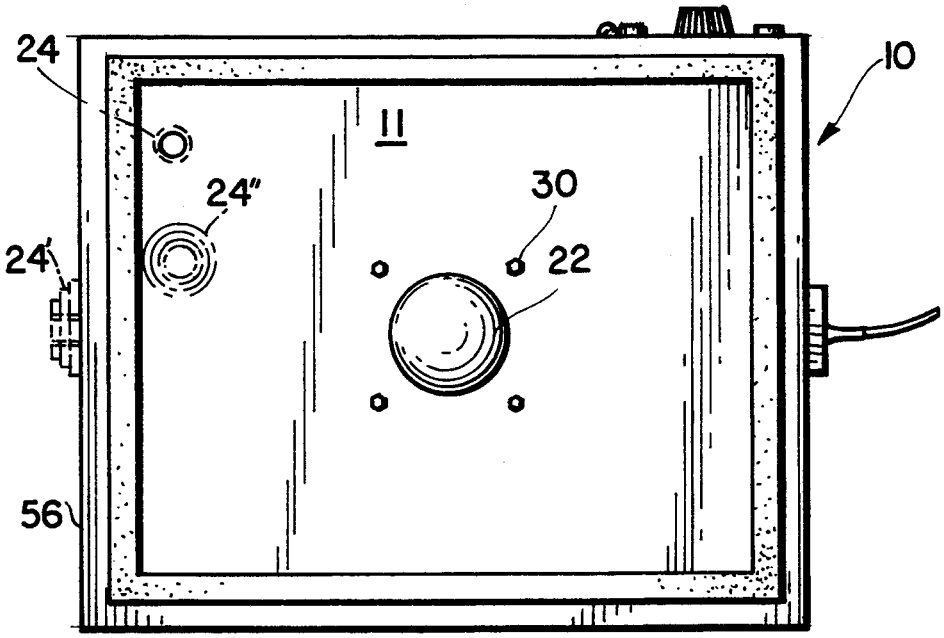
FIG. 3 is a bottom plan view of the rocking crib of FIG. 1.
Figure 4:
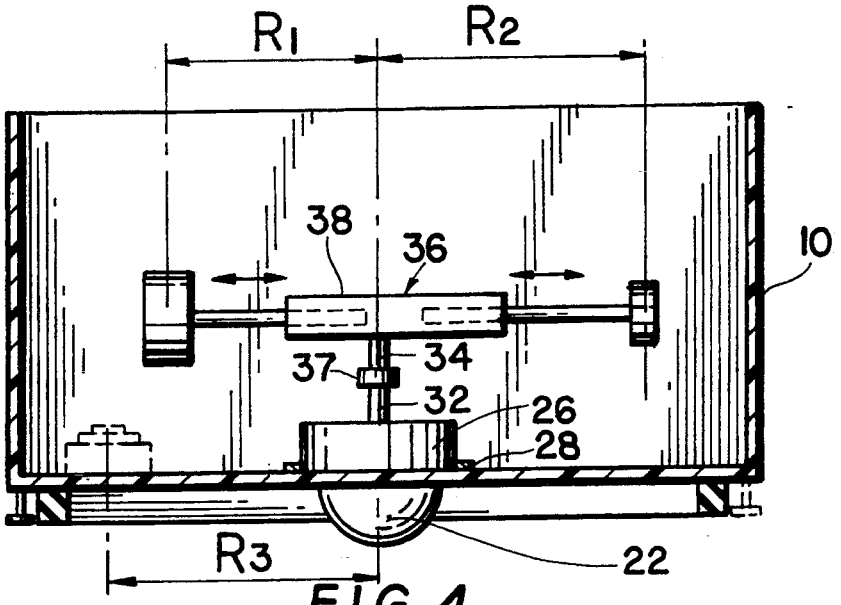
FIG. 4 is a sectional view of the rocking crib of FIG. 1, illustrating the pivot and the T-shaped member.

Rocking base 10, as best seen in FIGS. 3 and 4, is provided with a center pivot 22 in the form of a semi-hemispherical member located on the underside of rocking base 10. In one preferred embodiment, the center pivot 22 is located and projects from the geometric center of the rocking base 10 so that the base 10 moves in different planes relative to a base surface or floor on which the pivot 22 rests and the base 10 moves out of a horizontal plane parallel to the plane of the floor. Center pivot 22 is suitable to rest and to act as a center point for pivoting on a floor or other substantially flat surface. Since the center pivot 22 might leave rocking base 10 in a floating position, on the inside of base 10, weighted member 24 is provided at one end to maintain base 10 in a stable tilted condition. The location of the weighted member 24 is such to maintain that portion of the base 10 in a preselected stable condition because of the impact or load placed onto rocking base 10.

Also contained within base 10 are other parts and controls which also affect the maintenance of the base 10 in the stable condition, while at the same time permitting the edges of the base to be sequentially raised above the floor or other level plane. Depending on the location of the various parts contained within the rocking base 10 will determine the weight of the adjustable weighted member 24 and the adjustment, as explained subsequently.

Motor 26 in one embodiment, see FIG. 1, is fastened inside base 10 to flat plate 28 forming part of the inside bottom of base 10 by any conventional means, such as bolts 30. Holder or cross straps 31 are connected with bolts 30 to hold motor 26 and flat plate 28 to base 10.

Center pivot 22 may be molded to the outside face 11 of the bottom of base 10 or it may be a separate member connected with plate 28.

Motor 26 includes a center rotatable output shaft 32 connected to a center leg 34 of a T-shaped member 36 (FIG. 1 embodiment) by means of coupling 37. T-shaped member 36 has a top member 38 which is transverse to and perpendicular to center leg 34. Top member 38 is provided with ends or arms 40 and 42 radially displaced from center leg 34 and orthogonal thereto. Positioned on end 40 is a first weighted member 44, and positioned on end 42 is a second weighted member 46. It is important that one of the weighted members 44 or 46 have a weight greater than the weight of the other weighted member 44 or 46. If weighted member 44 is selected to be the larger weight, it is important that the combined torque relationship of adjustable weighted member 24 and the smaller weighted member 46 and arm 42 be greater than or at least equal to the torque produced by weighted member 44 arm 40.

While members 44 and 46 are referred to as weighted members, the effect produced is due to the torque produced as a result of the length of the arms 42 and 46.

The T-shaped member 36 includes a top member 38 having a center portion 39 to receive arm 40 and arm 42. Arms 40 and 42 are adjustable and movable into and out of the center portion 39 to adjust the length of arms 40 and 42 and, therefore, the distance of weights 44 and 46 from the center rotational axis through center leg 34 and thereby the torque effect of each arm.

By adjustment of weighted member 24, it is also possible to have the mattress tilted in the same direction or in a different direction in a rest position or non-operating condition. If it is not desired to have the crib set up so that it will automatically be tilted in the same direction or balanced, then the adjustable weight 24 can be adjusted so that the crib is tilted in one preselected rest condition. With adjustable weighted member 24, different possibilities are provided for the inclination or non-inclination of the mattress in the rest and operating condition.

Figure 2:
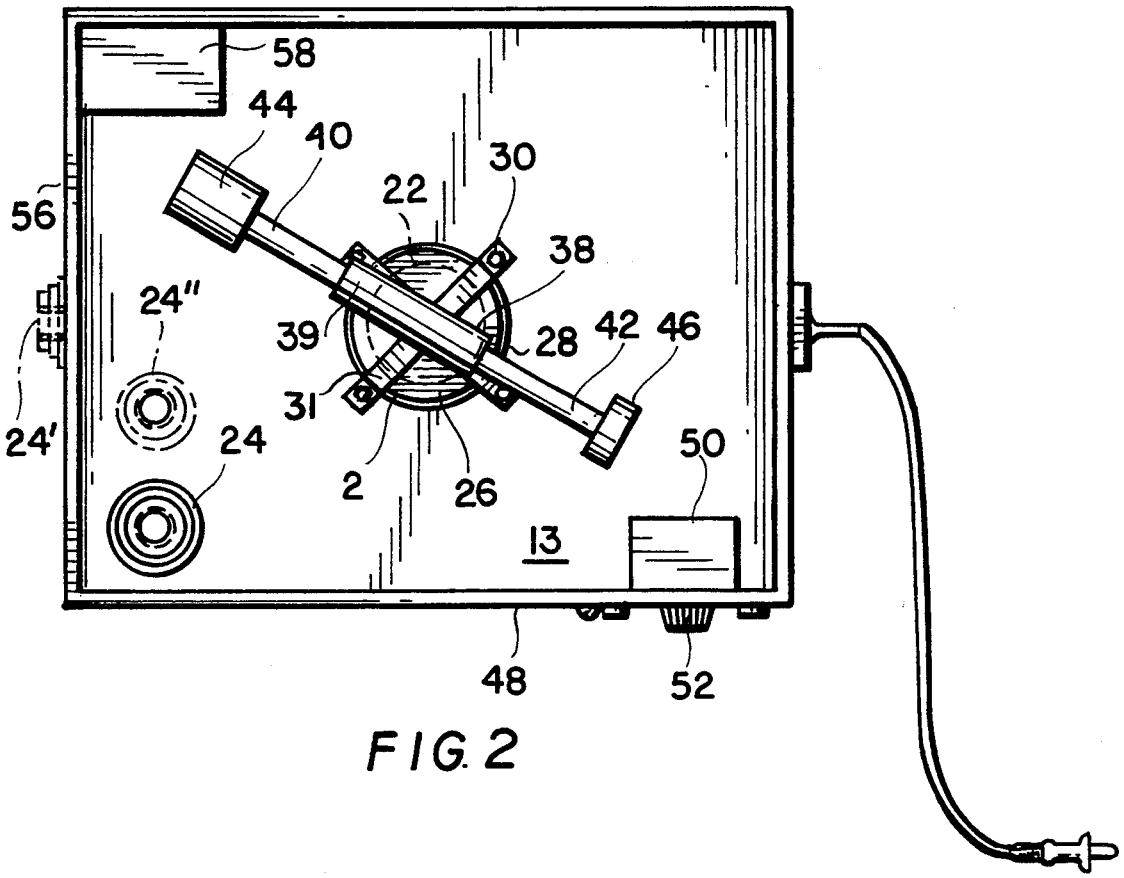
FIG. 2 is a top plan view of the rocking crib of FIG. 1.

Referring now more particularly to FIGS. 2 and 3 which show additional adjustable weighted members 24' and 24''. These are generally of the same type as adjustable weighted member 24 but placed on different parts to provide for ease of adjustment. For example, adjustable weighted member 24' which is shown on side 56 is usable to adjust the weight and pivoting from the side, and adjustable weighted member 24'' which is shown on the outside bottom 11 and is the same type as adjustable weighted member 24 which rests on inside base 13 of the non-directional rocking base.

One of the sides, such as side 48 of base 10 can be provided with various controls including a rheostat 50 controlled by outside control 52 which is connected with motor 26. Motor 26 can be electrically energized from an available power source and, for this purpose, electrical connector 27 is provided and pilot light 98 may be provided to indicate when electrical power is on. Outside control 52 can also include an on-off switch.

Side 48 is orthogonal to side 54, and it is opposite to side 56 and both sides 54 and 56 are connected with side 60. Schematically shown at the corner of the intersection of sides 56 and 60 is a rechargeable battery pack 58. Side 60 is opposite to side 48 and transverse to sides 54 and 56. However, the battery pack 58 can also be placed along another wall and the weight taken care of by the selection of weighted member 24.

Figure 5:
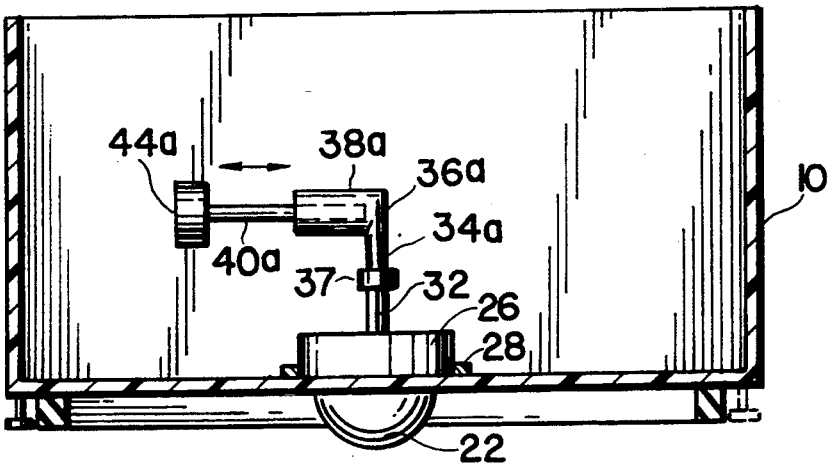
FIG. 5 is a sectional view similar to the sectional view of FIG. 4, illustrating an L-shaped member in lieu of the T-shaped member and illustrating a modification of the crib of FIG. 1.

Referring now more particularly to FIG. 5 of the drawings which shows an L-shaped member **36*a* having one arm 34*a* connected with motor 26 by means of coupling 37. For this purpose, L-shaped member 36*a* includes an arm 40*a* which is movable and adjustably received in top coupling 38*a* and together with arm 40*a* forms the other leg of L-shaped member 36*a***.

Figure 6:
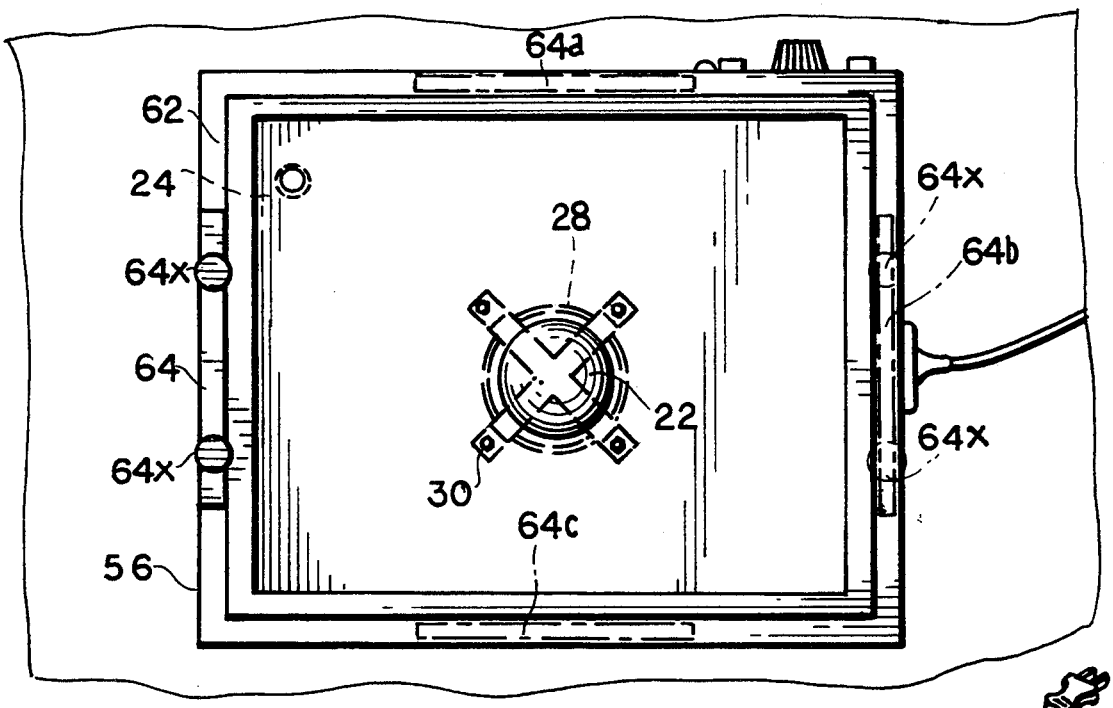
FIG. 6 is a bottom plan view of another modification of the crib of FIG. 1 showing a larger top portion on which the baby sleeps and raised parts to control or limit the amount of undulation.

Referring now more particularly to FIG. 6, side 56 has a lower edge 62 which is adapted to rest on the floor or other flat surface.

If it is desired to change the vertical movement of the base 10 as the T-shaped member 36 or as L-shaped member **36*a* rotates, edge 62 of side 56 can be provided with a projecting or adjustable member 64 provided with adjustment members or adjustment bolts 64*x* for raising one side of the crib above the other so that it will have a predetermined incline in the rest position or neutral position of the crib. Further, if it is desired to provide a variation in the amount of vertical extent, each bottom edge of each side may be provided with adjustable member 64*a*, 64*b* and 64*c*, which can be the same as or different from adjustable member 64. Also, if desired, only certain selected sides can be provided at the base facing the floor. Adjustment members similar to adjustment members 64*x* can also be provided for adjustable members 64*a* and 64*c*, as shown in FIG. 7 for side 54**; these adjustment members are not shown, for purposes of clarity.

Figure 7:
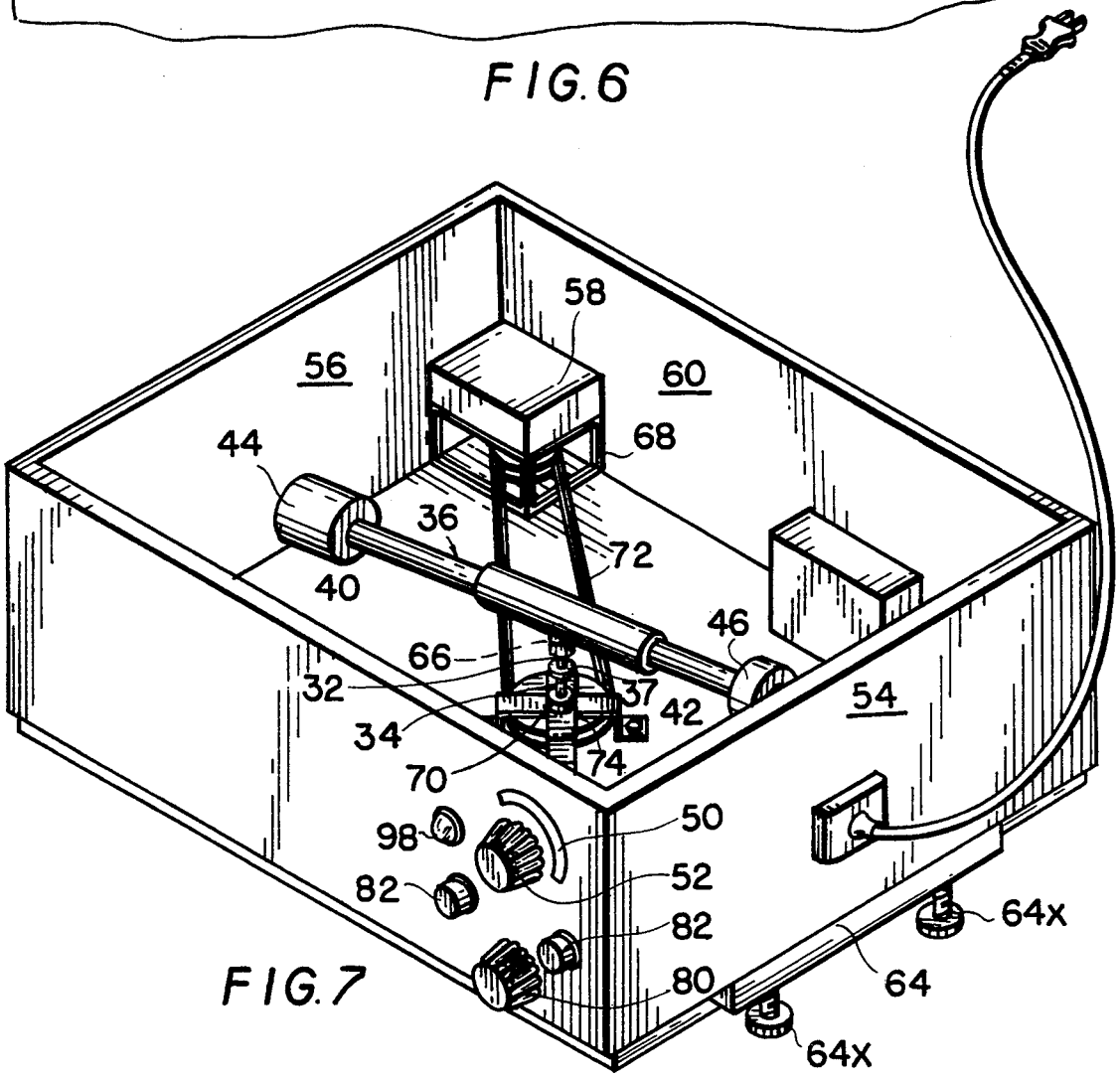
FIG. 7 is another modification of the base portion of the FIG. 1 embodiment showing a different drive in the form of a belt and pulley combination.

T-shaped member 36 can be provided with a center leg 34 which has an internal opening 66, as best seen in FIG. 7, so that it can be keyed to rotatable output shaft 32 and easily removable for storage or moving. In a similar manner, L-shaped member **36*a* can be provided with leg 34*a* so that it can be keyed to rotatable output shaft 32**.

Another embodiment is shown in FIG. 7 in which a motor, schematically shown at 68, can be provided at one end, such as between sides 56 and 60. Also, for the sake of compactness, the rechargeable batteries can be placed above the motor 68. Center shaft or leg 34 of T-shaped member 36 can be suitably received in a bearing 70 and rotated by means of belt 72 and pulley 74 to impart rotation to the T-shaped member 36. In this embodiment, the T-shaped member 36 is shown separate from, but mechanically connected with the motor. L-shaped member **36*a* can also be used in this embodiment. In this embodiment, holder 31 acts as a guard for belt 72. Holder 31 is connected by means of bolts 73 to bottom base 76**.

Figure 8:
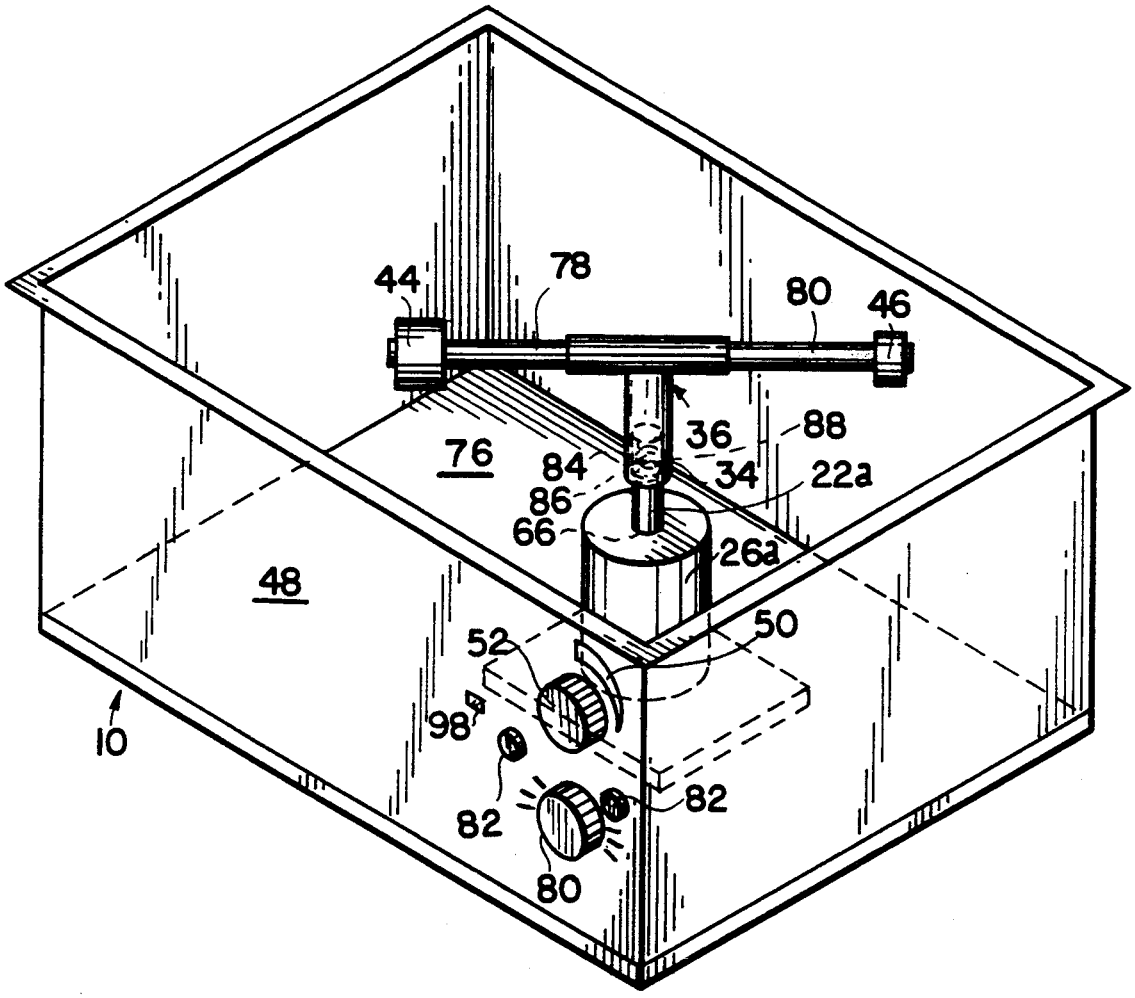
FIG. 8 is another modification of the base portion of the FIG. 1 embodiment with the motor in an off center position.

FIG. 8 shows another embodiment in which pivot **22*a* and motor 26*a* are not centered at the bottom base 76 of multi-directional rocking crib 10. As motor 26*a* rotates, T-shaped member 36 also rotates and the arm 78 or arm 80 together with weights 44 and 46 on ends of top members 40, 42, respectively, cause the multi-directional rocking base to be weighted towards the flat plane with the sides moving in a vertical direction substantially parallel to an axis which passes through eccentric pivot 22a and leg 34 of T-shaped member 36**.

Another knob 80 is shown on side 48 for the control of another device, such as a sound device 82 of the type disclosed in U.S. Pat. No. 5,063,912 issued on Nov. 12, 1991 to John Stewart Hughes.

To facilitate transportation, the base 10 and crib 12 and other parts can be made readily foldable and disconnectable for storage. For example, T-shaped member 36 can include a center T-member 84 which includes springs 86 and 88 similar to internal opening 66 to receive arms 78, 80, respectively.

Figure 9:
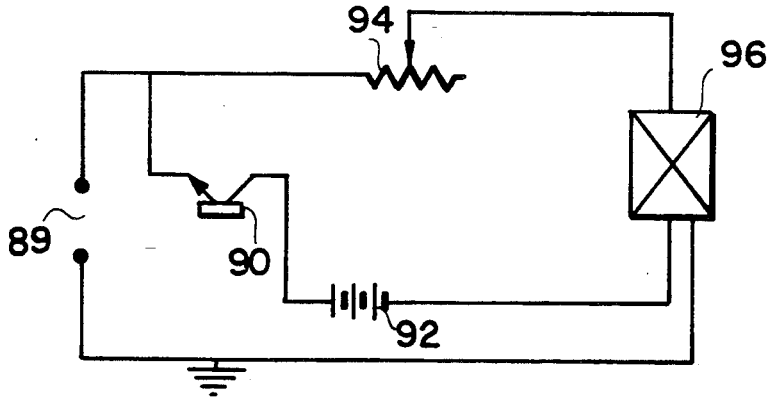
FIG. 9 is a schematic circuit diagram of the circuitry.

Referring now more particularly to FIG. 9 which shows the circuitry for the operation, the circuit includes an electrical supply 89, a transistor 90 to control recharging of rechargeable battery 92, a rheostat 94 and a motor 96 whose speed is controlled by rheostat 94. Pilot light 98 is also shown on the front face to indicate when the apparatus is in operation with the rheostat in such a position that no movement of the crib is taking place.

Of course, appropriate safety devices can be added to assure safety of operation to prevent injury to the child.

While the invention has been disclosed and described in connection with a torque member having one and two arms, it is within the scope of the invention to use a single torque arm employing an L-shaped member or dual torque arms using a T-shaped member. If a more precise refinement in the undulating action of the base is desired more than two torque arms such as four arms can be used with the weights on intermediate torque arms between opposite diagonal extremities can be provided so that they vary in weight between the maximum weight on one arm and the minimum weight on the other diagonally opposite arm. If four arms are used, then the weights at the ends of the diametrically opposite arms between the two arms, one of which has a maximum weight and the other of which has a minimum weight.

If three arms are used, it is preferred that they not be equiangularly spaced so that different weights can be used to achieve a different undulating action as the arms rotate about the pivot.

While there have been shown what are considered to be preferred embodiments, various changes and modifications may be made therein without departing from the scope of the invention.

I claim:

1. A multi-directional rocking crib, comprising:

a base portion having an outer perimeter including a pivot member projecting from said base portion about which said base portion pivots, said pivot member being displaced from said outer perimeter inwardly thereof;

pivoting means associated with said pivot member for pivoting of said base portion, including a first member operatively associated with said pivot member and a second member including at least one arm extending transversely to and connected with said first member;

adjustable means associated with said base portion for maintaining thereof in a stable rest position;

means associated with said pivoting means for rotation thereof; and weighted means coupled with said pivoting means at a free end of said one arm for tilting of said base portion or movement of said base portion into different planes as said first member rotates relative to said pivot member to provide an undulating movement of the edge of each side of said base portion as said pivot member rotates to move said base portion into and out of said different planes.

2. The crib as claimed in claim 1, wherein said pivot member is a center pivot and located in the geometric center of said base.

3. The crib as claimed in claim 1, wherein said pivot member is an offset pivot offset from a geometric center of said base portion.

4. The crib as claimed in claim 1, wherein said pivoting means is a T-shaped member including a center leg forming said first member associated with said pivot member and a cross-bar forming a tee portion of said T-shaped member, and having first and second arms extending from said first member, and an individual weight coupled to a free end of each of said first and said second arms, said individual weights being different from each other to provide for said undulating movement of the edge of each side of said base.

5. The crib as claimed in claim 1, wherein said pivoting means includes an L-shaped member forming said first member and said second member with one end of each of said first member and said second member being connected, and a weight on the free end of one of said arms, and the free end of the other of said arms being rotatably connected with said pivot member.

6. The crib as claimed in claim 1, wherein said base portion is substantially rectangularly-shaped and has two length sides and two width sides, said length sides being of greater extent than said two width sides, said pivot member being disposed closer to one of said width sides, and means coupling a motor with said pivoting means for movement of said base portion about said pivotal member.

7. The crib as claimed in claim 6, including a projection proximate to the other of said width sides for preventing the other of said width sides from being lowered or raised above the amount said one width side is lowered or raised, respectively.

8. The crib as claimed in claim 1, including a motor coupled with said pivoting means and means connecting said first member with an output shaft of said motor for rotation coaxially with an axial center of said pivot member.

9. A multi-directional rocking crib, comprising:

a member having at least three sides for supporting an infant, said member having different size sides spaced from each other, each two adjacent sides of said member being joined together to form at least three corners, each two spaced corners of said at least three corners forming one set of two corners, at least one set of two corners being diagonally related to each other; and means for imparting an undulating movement to said member by raising one corner of said at least one set of two corners in a substantially vertical direction while lowering the other corner of said at least one set of two corners while commencing the raising of one corner of another set of two corners and lowering the other corner of said other set of two corners to impart said undulating movement to said member by sequentially having a first corner reach its maximum height while its diagonally opposite corner reaches its lowest height and corners intermediate said first corner and said its diagonally opposite corner reaching a position between said one corner and said its diagonally opposite corner; and adjustable means coupled with said member for maintenance thereof in a preselected position.

10. A multi-directional rocking crib of claim 9, wherein said member is a substantially rectangularly-shaped member having four sides for supporting an infant, said rectangularly-shaped member having two long and two short sides spaced from each other, said short sides being joined at opposite ends to said long sides to form four corners, a first set of two corners being diagonally related to each other and a second set of two corners being diagonally related to each other; and said means for raising one corner of said first set of two corners raises said one corner in a substantially vertical direction while lowering the other corner of said first set of two corners in a substantially vertical direction while commencing the raising of one corner of the second set of two corners and lowering the other corner of said second set of two corners to impart said undulating movement to said rectangularly shaped member.

11. The crib of claim 9, including means at one of said sides for controlling the extent to which said one side is lowered when a side opposite to said one side is raised.

12. The crib according to claim 9, including a pair of arms to rotate about a pivot spaced from said long and said short sides inwardly thereof for lowering and raising said corners and said sides of said member as said arms rotate.

13. The crib according to claim 9, including a pivot member at the bottom of said member at an outside face portion thereof for contact with a flat surface and a T-shaped member received in a rotatable joint coupled with said pivot for raising and lowering said member as said T-shaped member rotates relative to said pivot to cause said member to move in response to a rotatable see-saw action imparted to said member by said T-shaped member.

14. A multi-directional rocking crib, comprising:

a base portion including a pivot member about which said base portion pivots;

pivoting means associated with said pivot member for pivoting of said base, including a first member operatively associated with said pivot member and a second member including at least one arm extending transversely to and connected with said first member;

means associated with said pivoting means for rotation thereof; and weighted means coupled with said pivoting means at a free end of said one arm for tilting of said base portion or movement of said base portion into different planes as said first member rotates relative to said pivot member to provide an undulating movement of the edge of each side of said base portion as said pivot member rotates to move said base portion into and out of said different planes;

said pivoting means being a T-shaped member including a center leg forming said first member associated with said pivot member and a cross-bar forming a tee portion of said T-shaped member, and having first and second arms extending from said first member, and an individual weight coupled to a free end of each of said first and said second arms, said individuals weights being different from each other to provide for said undulating movement of the edge of each side of said base.

15. A multi-directional rocking crib, comprising:

a member for supporting an infant, opposite portions of said member being diagonally related to each other and forming at least one set of two diagonally opposite portions;

means for imparting an undulating motion to said member by raising one of said two opposite portions of at least one set of two opposite portions in a substantially vertical direction while lowering the other portion of said at least one set of two opposite portions and lowering said one corner of said at least one set of two corners while commencing the raising of one portion of another set of two opposite portions and lowering the other portion of said other set of two opposite portions to impart an undulating movement to said member; and means coupled with said member for maintenance thereof in a preselected position.

16. The multi-directional rocking crib of claim 15, wherein said member is a substantially rectangularly-shaped member having four sides for supporting an infant, said rectangularly-shaped member having two long and two short sides spaced from each other, said short sides being joined at opposite ends to said long sides to form four corners, a first set of two corners being diagonally related to each other and a second set of two corners being diagonally related to each other; and said means for raising one corner of said first set of two corners raises said one corner in a substantially vertical direction while lowering the other corner of said first set of two corners in a substantially vertical direction while commencing the raising of one corner of the second set of two corners and lowering the other corner of said second set of two corners to impart said undulating movement to said rectangularly shaped member.

17. The multi-directional rocking crib of claim 15, wherein said member has at least three sides for supporting an infant, said member having different size sides spaced from each other, each two adjacent sides of said member being joined together to form at least three corners, each two spaced corners of said at least three corners forming one set of two corners, at least one set of two corners being diagonally related to each other; and said means for imparting an undulating motion to said member by raising one corner of said at least one set of two corners in a substantially vertical direction while lowering the other corner of said at least one set of two corners while commencing the raising of one corner of other set of two corners and lowering the other corner of said other set of two corners to impart the undulating motion to said member by sequentially having a first corner reach its maximum height while its diagonally opposite corner reaches its lowest height and corners intermediate said first corner and said its diagonally opposite corner reaching a position between said one corner and said its diagonally opposite corner.

18. The crib according to claim 15, wherein said means for imparting an undulating motion to said member for supporting an infant includes a weighted member associated with a pivot member coupled with said member.

19. A multi-directional rocking crib, comprising:

a base portion having an outer perimeter including a pivot member projecting from said base portion about which said base portion pivots, said pivot member being displaced from said outer perimeter inwardly thereof;

pivoting means associated with said pivot member for pivoting of said base portion, including a first member operatively associated with said pivot member and a second member including at least one arm extending transversely to and connected with said first member;

a projection associated with one side of said outer perimeter and another side of said outer perimeter opposite to said one side, said projection being provided for preventing said one side thereof from being raised or lowered more than the amount said other side is raised or lowered;

means associated with said pivoting means for rotation thereof; and weighted means coupled with said pivoting means at a free end of said one arm for tilting of said base portion or movement of said base portion into different planes as said first member rotates relative to said pivot member to provide an undulating movement of the edge of each side of said base portion as said pivot member rotates to move said base portion into and out of said different planes.

20. A multi-directional rocking crib, comprising:

a base portion having an outer perimeter including a pivot member projecting from said base portion about which said base portion pivots, said pivot member being displaced from said outer perimeter inwardly thereof;

pivoting means associated with said pivot member for pivoting of said base, including a T-shaped member comprising a center leg operatively associated with said pivot member and a cross-bar forming a tee portion of said T-shaped member, and first and second arms extending from said cross-bar; and an individual weight coupled to a free end of each of said first and second arms, said individual weights being different from each other for tilting of said base portion or movement of said base portion into different planes as said T-shaped member rotates relative to said pivot member to provide an undulating movement of the edge of each side of said base portion as said pivot member rotates to move said base portion into and out of said different planes.

21. A multi-directional rocking crib, comprising:

a base portion having an outer perimeter including a pivot member projecting from said base portion about which said base portion pivots, said pivot member being displaced from said outer perimeter inwardly thereof;

pivoting means associated with said pivot member for pivoting of said base, including an L-shaped member having one arm provided with a free end rotatably connected with said pivot member and another arm extending transversely to and connected with said other arm;

means associated with said pivoting means for rotation thereof; and weighted means including a weight on the free end of said other arm for tilting of said base portion or movement of said base portion into different planes as said first member rotates relative to said pivot member to provide an undulating movement of the edge of each side of said base portion as said pivot member rotates to move said base portion into and out of said different planes.

* * * * *